US008182974B2

(12) United States Patent
Uno

(10) Patent No.: US 8,182,974 B2
(45) Date of Patent: May 22, 2012

(54) METHOD FOR PRODUCING NEGATIVE CHARGING TONER

(75) Inventor: Takanori Uno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 561 days.

(21) Appl. No.: 12/412,143

(22) Filed: Mar. 26, 2009

(65) Prior Publication Data

US 2009/0246669 A1 Oct. 1, 2009

(30) Foreign Application Priority Data

Mar. 31, 2008 (JP) ..... 2008-089611

(51) Int. Cl.
*G03G 9/087* (2006.01)

(52) U.S. Cl. ..... 430/137.11; 430/137.14

(58) Field of Classification Search ..... 430/109.4, 430/108.4, 108.1, 110.2, 137.11, 137.14
See application file for complete search history.

(56) References Cited

U.S. PATENT DOCUMENTS

| | | | | |
|---|---|---|---|---|
| 6,030,738 | A | 2/2000 | Michel et al. | |
| 6,248,491 | B1 * | 6/2001 | Takayanagi et al. | 430/123.53 |
| 7,029,813 | B2 | 4/2006 | Mikuriya et al. | |
| 7,553,600 | B2 * | 6/2009 | Kawamura et al. | 430/137.14 |
| 7,960,085 | B2 * | 6/2011 | Kawamura et al. | 430/137.11 |
| 2002/0064723 | A1 * | 5/2002 | Nanya et al. | 430/108.22 |
| 2006/0063082 | A1 | 3/2006 | Mikuriya et al. | |
| 2006/0127788 | A1 * | 6/2006 | Yamashita et al. | 430/109.1 |
| 2006/0165450 | A1 * | 7/2006 | Koike et al. | 399/346 |
| 2007/0072103 | A1 * | 3/2007 | Kawamura et al. | 430/108.2 |
| 2008/0107989 | A1 * | 5/2008 | Sacripante et al. | 430/109.4 |

FOREIGN PATENT DOCUMENTS

| | | |
|---|---|---|
| JP | 59-170853 | 9/1984 |
| JP | 05-134444 | 5/1993 |
| JP | 05-333583 | 12/1993 |
| JP | 11-124565 | 5/1999 |
| JP | 2005-62818 | 3/2005 |
| JP | 2006-091648 | 4/2006 |
| JP | 2006-119607 | 5/2006 |
| JP | 2007-094041 | 4/2007 |
| JP | 2007-286246 | 11/2007 |

OTHER PUBLICATIONS

Office Action received for JP Application No. 2008-89611 mailed Feb. 16, 2010.

* cited by examiner

*Primary Examiner* — Christopher Rodee
(74) *Attorney, Agent, or Firm* — Banner & Witcoff, Ltd.

(57) ABSTRACT

An object of the present teachings is to provide a method for producing a negative charging toner having a fine surface charge state. For this object the present teachings provide a method for producing a negative charging toner comprising a polyester resin as a main component is provided. The method comprises steps of producing base particles by emulsifying the polyester resin; causing a positively charged compound to be carried on the surfaces of the base particles and producing toner base particles by bringing the base particles carrying the positively charged compound into contact with negative charge control resin microparticles such that the negative charge control resin microparticles are fixed to the surfaces of the base particles.

6 Claims, 2 Drawing Sheets

METHOD FOR PRODUCING NEGATIVE CHARGING TONER

CROSS REFERENCE TO RELATED APPLICATION

The present application claims priority to Japanese Patent Application No. 2008-089611, filed on Mar. 31, 2008, the contents of which are hereby incorporated into the present application by reference.

BACKGROUND OF THE INVENTION

1. Field of the Invention

The present invention relates to a method for producing a negative charging toner.

2. Description of the Related Art

In an electrophotographic or an electrostatic recording image forming apparatus, an image can be formed on a piece of paper by supplying a toner that is charged with a predetermined polarity and to a predetermined amount of charge, to an image forming section thereby distributing the toner over the paper so as to form the image, through the effect of an electric field, and then fixing the toner thus distributed over the paper.

The toner may be a magnetic two-component toner, in which the toner is charged through frictional charging by a magnetic carrier, or a non-magnetic mono-component toner, which is charged by friction with a contact section of the image forming apparatus, without using any magnetic carrier. Non-magnetic mono-component toners are advantageous for reducing the size of the image forming apparatus.

Generally known such non-magnetic mono-component toners include toners having a main component of polyester resin, which is a binder resin. When using such toners as the negative charging toners, it is necessary to employ a negatively chargeable charge control agent (CCA) or charge control resin (CCR).

Known conventional wet process methods for producing such toners include, for instance, suspension polymerization methods, ester extension methods, solution suspension methods, emulsification aggregation methods and the like. In the production of a negative charging toner using the polyester resin as the binder resin, the polyester resin is negatively chargeable. Hence, after the production of the base particles, it is not possible to fix the negatively charged charge control resin microparticles or the like to the surfaces of the base particles made of polyester resin within a liquid. For this reason, the toner base particles are produced by mixing beforehand the binder resin with the charge control agent or the like (Japanese Patent Application Laid-open No. 2005-62818).

SUMMARY OF THE INVENTION

However, the inventors have found that when a negative charge control agent or the like is mixed into toner base particles having a polyester resin as a binder resin, the charge state on the surfaces of the toner base particles tends to become uneven. Specifically, regions of polyester resin alone, with no charge control agent or the like present may be formed. The charge state among toner particles is likelier to become uneven as a result. This inhomogeneous charge state on the toners gives rise to image defects such as fogging and transfer residues. Also, the intended amount of charge cannot be easily obtained when mixing the negative charge control agent or the like to the polyester resin.

Therefore, it is an object of the present teachings to provide a method for producing a negative charging toner having a fine surface charge state.

After diligent research directed at solving the above problems, the inventors found that applying beforehand a positively charged compound to the surfaces of polyester resin base particles is effective for fixing negative charge control resin microparticles to the surfaces of the base particles via the positively charged compound. The inventors created the present teachings on the basis of the aforesaid finding. The disclosure of the present description provides the means below.

According to the disclosure of the present description, a method for producing a negative charging toner comprising a polyester resin as a main component is provided. The method comprises steps of producing base particles by emulsifying the polyester resin; causing a positively charged compound to be carried on the surfaces of the base particles (hereinafter may be referred to as a 'positively charged compound carrying step'); and producing toner base particles by bringing the base particles carrying the positively charged compound into contact with negative charge control resin microparticles such that the negative charge control resin microparticles are fixed to the surfaces of the base particles.

In the method for producing the negative charging toner disclosed in the present description, the positively charged compound carrying step may comprise supplying the positively charged compound to a suspension of the base particles, and performing thereafter solid-liquid separation on the base particles carrying the positively charged compound. In the positively charged compound carrying step, the number of positive charge sites of the positively charged compound relative to the weight of the base particles may be set to be not smaller than $6.60\times10^{-5}$ mol/g. Further, the positively charged compound may have a plurality of positive charge sites per molecule, and may have an amino group and/or a quaternary ammonium group as a positive charge site. The positively charged compound may be selected from the group consisting of polyallylamines, polyethyleneimines and benzethonium chloride.

DESCRIPTION OF THE PREFERRED EMBODIMENTS

The present teachings disclosed herein relates to a method for producing a negative charging toner. The characterizing feature of the method for producing the negative charging toner of the present teachings is that negative charge control resin microparticles are fixed to the surfaces of base particles by bringing the base particles, upon which a positively charged compound is carried on their surfaces, into contact with the negative charge control resin microparticles. The present teachings allow achieving uniform fixing of the negative charge control resin microparticles due to the positively charged compound held on the surfaces of the base particles. As a result, a negative charging toner having fine charge state in that the surface charge state is made homogeneous within each toner particle and among toner particles. Also, a negative charging toner having a sufficient amount of charge can be easily obtained by using the charge control resin microparticles having higher negative polarity than a polyester resin. This allows stable forming of fine images from which fogging and transfer residues are suppressed.

In the method for producing the negative charging toner of the present teachings, causing the positively charged compound to be carried on the surfaces of the base particles allows achieving a state in which negative charge control resin microparticles can readily adhere to the surface of each base particles. As a result, this allows fixing the negative charge control resin microparticles in the desired amount.

Figure 1:
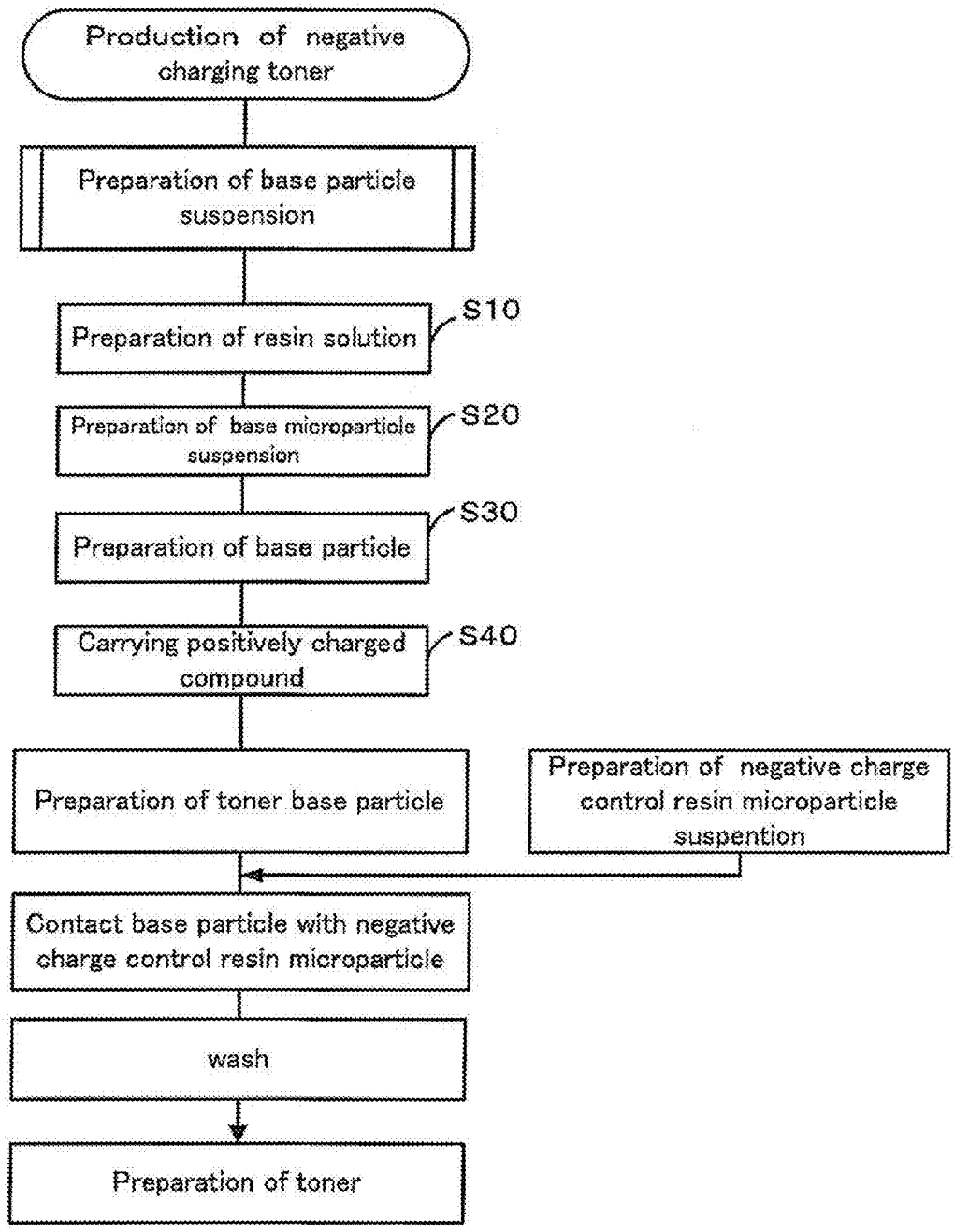
FIG. 1 is a schematic flowchart illustrating an example of a production process of a negative charging toner of the present teachings.
Figure 2:
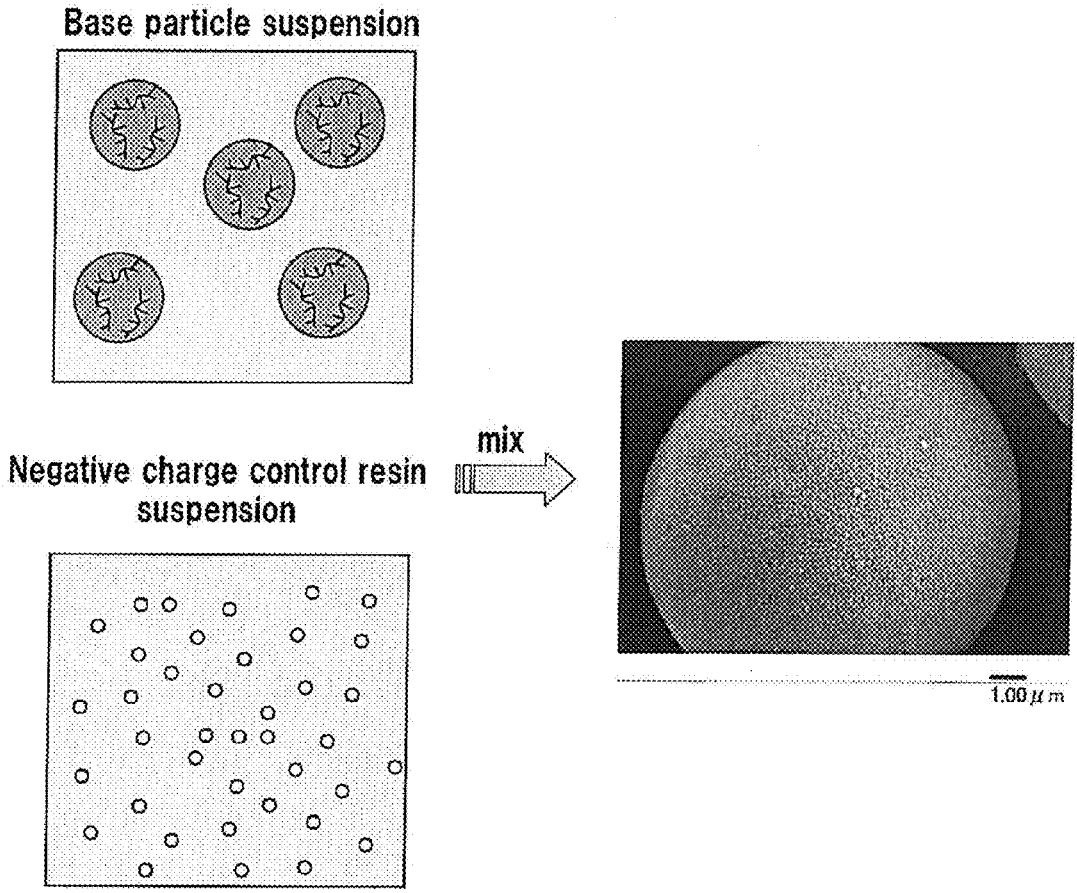
FIG. 2 is a diagram illustrating schematically an example of the step of causing a positively charged compound to be carried on toner base particles of the present teachings.

An embodiment of the method for producing the negative charging toner of the present teachings will be explained in detail next with reference to the accompanying drawings. The various materials used in the production of the negative charging toner of the present teachings will be explained first, and the production method itself to follow thereof. FIG. 1 is a schematic flowchart illustrating an example of the production process of the negative charging toner of the present teachings. FIG. 2 is a schematic diagram illustrating an example of the step of causing the positively charged compound to be carried on the toner base particles of the present teachings.

In the present description, the term "resin solution" denotes a solution resulting from dissolving or dispersing a binder resin, a colorant, and optionally a release agent, in an organic solvent. The term "aqueous medium" denotes a medium, comprising mainly water, and used during mixing and emulsifying of the resin solution. The aqueous medium may contain a neutralizer. The term "base microparticles" denote solid microparticles in a suspension from which an organic solvent component is removed, after micro-emulsification of the resin solution in water. The term "base particles" denotes particles having a size level of a toner, obtained through aggregation/fusion of base microparticles. The term "toner base particles" denotes particles resulting from fixing charge control resin microparticles on the surfaces of the base particles. The term "toner" denotes dried toner base particles, with a hydrophobic inorganic dispersant optionally added and adhered to the surfaces to the toner base particles. The term "charge control resin microparticles" denote microparticles having a charge control resin as a main component.

(Toner Constituent Materials)

The negative charging toner obtained in accordance with the production method of the present teachings comprises toner base particles. The toner base particles comprise base particles in which a polyester resin is the main component thereof with charge control resin microparticles on the surfaces thereof. Besides a binder resin, the base particles further comprise, for instance, a colorant, a release agent and a charge control agent. The toner base particles may have a hydrophobic inorganic dispersant on their surfaces.

(Binder Resin)

As the binder resin, although not limited thereto, a polyester resin that is conventionally used as the binder resin for toner may be used. The polyester resin is a commercially available polyester resin, having for instance an acid value of 0.5 to 40 mgKOH/g, preferably 1.0 to 20 mgKOH/g, a weight-average molecular weight (as measured by GPC based on standard polystyrene) of 9,000 to 200,000, preferably 20,000 to 150,000, and having a cross-linked fraction not higher than 10 wt % (THF insoluble fraction), preferably of 0.5 to 10wt %. A lower acid value than the above ranges entails a smaller amount of reaction with a base such as sodium hydroxide that is added later, as a result of which emulsification may be destabilized and a stable slurry may fail to be obtained. When the acid value is higher than the above ranges, the toner is more likely to become excessively charged, which may give rise to problems such as reduced image density. When the weight-average molecular weight is lower than the above range, the mechanical strength of the toner may be insufficient, which may detract from the durability of the toner. To the contrary, a weight-average molecular weight higher than the above ranges results in an excessively high melt viscosity in the toner and in large emulsion droplets, whereby coarse particles are more likely to form. Although the cross-linked fraction may be zero, a certain non-zero cross-linked fraction is nonetheless preferable for toner strength and fixabilty (in particular, high-temperature offset). However, an excessive cross-linked fraction may give rise to large emulsion droplets and coarse particles.

Polyester resins are superior in that they are transparent, are sufficiently colorless so as not to compromise toner image hue, have good compatibility with the above charge control resin as well as adequate fluidity when heated or under pressure, and can be made into microparticles. Polyester resins are also excellent in terms of charge stability and image quality.

To determine the molecular weight of the resin, the resin component is dissolved in THF, the insoluble component is filtered off with DISMIC™ (diameter 0.2 μm, made of PTFE, by ADVANTEC), the THF solution fraction is collected and is measured in a GPC instrument, and the molecular weight distribution is calculated in terms of standard polystyrene.

(Colorant)

The colorant, which imparts a desired color to the toner, is incorporated into the binder resin through dispersion or permeation. Carbon black may be used as the colorant. Other examples include, for instance, organic pigments such as Quinophthalone Yellow, Hansa Yellow, Isoindolinone Yellow, Benzidine Yellow, Perynone Orange, Perynone Red, Perylene Maroon, Rhodamine 6G Lake, Quinacridone Red, Rose Bengal, Copper Phthalocyanine Blue, Copper Phthalocyanine Green, or a diketopyrrolopyrole pigment; inorganic pigments and metal powders such as Titanium White, Titanium Yellow, ultramarine, Cobalt Blue, red iron oxide, aluminum powder, and bronze; oil-soluble dyes and dispersion dyes such as azo dyes, quinophthalone dyes, anthraquinone dyes, xanthene dyes, triphenylmethane dyes, phthalocyanine dyes, indophenol dyes, and indoaniline dyes; and rosin dyes such as rosin, rosin-modified phenol, and rosin-modified maleic acid resin. Other examples include dyes and pigments treated with higher fatty acids or resins. The foregoing can be used alone or in combinations corresponding to a desired color. In the case of monochromatic color toner, for instance, the colorant can be prepared by mixing a pigment and a dye of the same color, such as a rhodamine pigment and dye, a quinophthalone pigment and dye, or a phthalocyanine pigment and dye. The colorant is mixed at a ratio of, for example, 2 to 20 parts by weight, preferably 4 to 10 parts by weight, relative to 100 parts by weight of the binder resin.

(Release Agent)

The release agent is added in order to improve the fixability of the toner to the recording medium. In the case of heat and pressure fixing, a wax is ordinarily incorporated into the toner in such a manner that the toner can detach easily from a heating medium. Examples of the release agent include, for instance, ester waxes and hydrocarbon waxes. Examples of ester waxes include, for instance, aliphatic ester compounds, such as stearates, palmitates, as well as polyfunctional ester compounds such as pentaerythritol tetramyristate, pentaerythritol tetrapalmitate and dipentaerythritol hexapalmitate. Examples of hydrocarbon waxes include, for instance, polyolefin waxes such as low-molecular weight polyethylene, low-molecular weight polypropylene and low-molecular weight polybutylene; natural vegetable waxes such as candelilla wax, carnauba wax, rice wax, Japan wax (sumac wax) and Jojoba wax; petroleum waxes such as paraffin, microcrystalline and petrolatum, as well as modified waxes thereof; and synthetic waxes such as Fischer-Tropsch waxes. These waxes can be used alone or in combinations. Preferably, the wax is one of the above waxes having a melting point of 50 to 100° C. A wax having a low melting point and a low melt viscosity melts before melting of the binder resin and becomes smeared on the toner surface, even for a low heating temperature in the fixing device. As a result, offset can be prevented. More specifically, the wax is an ester wax or a paraffin wax. The wax is blended in a proportion of, for instance, 1 to 30 parts by weight, preferably 3 to 15 parts by weight relative to 100 parts by weight of the binder resin.

(Negative Charge Control Resin Microparticles)

The negative charging toner obtainable in accordance with the production method of the present teachings has negative charge control resin microparticles on the surfaces of the base particles. The negative charge control resin microparticles are microparticles having a negative charge control resin as its main component. The negative charge control resin used is not particularly limited, but is preferably a styrene-acrylic copolymer. Preferred styrene-acrylic copolymers are not particularly limited, but include, for instance, copolymers of styrene-based monomers such as styrene, o, m, p-chlorostyrene, α-methyl styrene, and alkyl (meth)acrylate monomers selected from alkyl acrylate such as (meth)acrylic acid, maleic acid, itaconic acid, methyl(meth)acrylate, ethyl(meth) acrylate, propyl(meth)acrylate, butyl(meth)acrylate, 2-ethylhexyl(meth)acrylate, amyl(meth)acrylate, cyclohexyl(meth) acrylate, lauryl(meth)acrylate, stearyl(meth)acrylate.

The weight-average molecular weight (Mw) of the negative charge control resin is preferably set in the range of 3000 to 100000. When the molecular weight (Mw) is less than 3,000, the charge control resin has poor strength, and toner particles aggregate readily. On the other hand, when the weight-average molecular weight (Mw) exceeds 100,000, the charge control resin may become excessively hard, impairing fixability. The charge control resin may be cross-linked.

Preferably, the glass transition temperature (Tg) of the negative charge control resin is similar to or slightly higher than that of the toner base particles. For instance, when the Tg of the toner base particles is 60° C., the Tg of the charge control resin is preferably set to 60 to 65° C.

The microparticles of the negative charge control resin being smaller is preferable, for more uniform microparticles can cover the surfaces of the base particles. Therefore, the average particle size of the charge control resin microparticles is preferably sufficiently small relative to the average particle size of the base particles and of a magnitude that does not substantially influence the average particle size of the toner base particles that are obtained through fixing of the negative charge control resin microparticles. The average particle size of the charge control resin microparticles varies depending on the average particle size of the toner to be obtained, but ranges preferably from about 50 to about 250 nm. The average particle size of the charge control resin microparticles can be determined by dynamic light scattering (laser Doppler), using a particle size analyzer Nanotrac™ UPA150 (manufactured by Nikkiso Co. LTD.). Specifically, the method set forth in the below examples may be utilized.

(Positively Charged Compound)

The positively charged compound used in the present invention is not particularly limited, so long as it has at least one positive charge site. Taking into account that the positively charged compound is carried on the surface of each base particle in an aqueous medium that comprises the base particles, the positively charged compound is preferably water-soluble. The positively charged compound preferably has a plurality of positive charge sites per molecule. The negative charge control resin microparticles can become fixed readily when the positively charged compound has the plurality of positive charge sites. The positive charge site is not particularly limited, but may be a primary to tertiary amine group, or a quaternary ammonium group.

Examples of the positively charged compound include, for instance, polymeric compounds such as polyethyleneimines, polyallylamines, polyvinylamines, polyamideamine-epichlorohydrin (PAE), a dicyandiamido polyalkylenepolyamine condensation product, a polyalkylene polyamine dicyandiamido ammonium salt condensation product, a dicyandiamido formalin condensation product, an epichlorohydrin-dialkylamine addition polymer, a diallyldimethylammonium chloride polymer, polyvinyl imidazole, a vinylpyrrolidone-vinylimidazole copolymer, polyvinylpyridine, polyamidine, chitosan, cationized starch, a vinylbenzyl trimethylammonium chloride polymer, a (2-methacryloyloxyethyl)trimethylammonium chloride polymer and a dimethylaminoethyl methacrylate polymer. Typical examples thereof are polyallylamines and polyethyleneimines.

Typical examples of compounds having primary amino groups, secondary amino groups, tertiary amino groups, quaternary ammonium groups and the like include, for instance, cationic surfactants. The cationic surfactant used is not particularly limited to such compounds, but is typically, for instance, benzethonium chloride or the like.

The positively charged compound of the present teachings may be used singly or in combinations of two or more. For instance, one compound or a combination of two or more compounds selected from the group consisting of polyallylamines, polyethyleneimines and benzethonium chloride may be utilized.

The charge control agent and charge control resin microparticles may be optionally enclosed in the base particles or the base microparticles.

(External Additive)

Examples of the external additive include inorganic particles and synthetic resin particles. Examples of the inorganic particles that can be used include, for instance, silica, aluminum oxide, titanium oxide, silicon aluminum cooxide, silicon titanium cooxide, and hydrophobicized products thereof. Hydrophobization of a silica micropowder may involve, for instance, treating the silica micropowder with silicon oil or a silane coupling agent such as dichlorodimethylsilane, hexamethyldisilazane, tetramethyldisilazane or the like. Examples of synthetic resin particles include, for instance, methacrylate polymer particles, acrylate polymer particles, styrene-methacrylate copolymer particles, styrene-acrylate copolymer particles, and core-shell particles in which a shell of a methacrylate polymer is formed on a core of a styrene polymer. The addition amount of external additive is not particularly limited, and ranges ordinarily from 0.1 to 6 parts by weight relative to 100 parts by weight of the toner comprising the toner base particles and the charge control resin.

(Method for Producing the Negative Charging Toner)

A method for producing the negative charging toner of the present teachings is explained below. The method for producing the negative charging toner of the present teachings is a method for producing a negative charging toner comprising a polyester resin as its main component, wherein the method may comprise a step of producing base particles by emulsifying the polyester resin; a positively charged compound carrying step of causing a positively charged compound to be carried on the surfaces of the base particles; and a toner base particle production step of bringing the base particles carrying the positively charged compound into contact with negative charge control resin microparticles, thereby to fix the negative charge control resin microparticles to the surfaces of the base particles. The production method of the present teachings belongs to the so-called solution suspension methods and emulsification aggregation methods. Among these two, the production method of the present teachings is suitable for emulsification aggregation, in which base particles of desired size are produced through aggregation of resin microparticles (base microparticles) that are obtained by emulsifying the binder resin using an emulsifier. With reference to FIG. 1, an explanation follows hereinbelow with an example of the production process in which a toner is ultimately produced by preparing a base microparticle suspension from a polyester resin solution, then producing predetermined base particles by aggregating the base microparticles, causing the positively charged compound to be held on the surfaces of the base particles, and further causing negative charge control resin microparticles to be fixed to the surfaces of the base particles, and thereby to produce toner base particles, which process is followed by washing.

(Production of the Base Particles)

The production of the base particles comprises steps S10 through S40. Step S10 prepares a resin solution containing a polyester resin. Step S20 is a base microparticle production step of mixing and emulsifying the resin solution and an aqueous medium thereby to produce base microparticles. Step S30 is a base particle production step. Step S40 is a positively charged compound carrying step of causing a positively charged compound to carry on the surfaces of the base particles.

(Resin Solution Preparation: Step S10)

As illustrated in FIG. 1, firstly the binder resin and the colorant, and optionally the release agent, are dissolved or dispersed in the organic solvent. Preferably, the binder resin is dissolved in the solvent. When using a pigment as the colorant, the pigment is micro-dispersed, since it does not dissolve. Although the release agent is preferably dissolved as well, it need not necessarily be dissolved, and may be micro-dispersed instead. In the preparation of the resin solution, the resin solution may be appropriately heated at a temperature not higher than the boiling point of the organic solvent. Such heating is particularly preferred when a release agent is dissolved or dispersed.

Preferably, the organic solvent dissolves a wax at a temperature below the boiling point, but it is also desirable that the organic solvent should exhibit some water solubility in order to promote emulsification of the binder resin. In the production method of the present invention, it is particularly preferred to reduce the use of dispersants such as surfactants or the like for stabilizing an emulsion of the resin solution. It becomes then necessary to neutralize the hydrophilic groups of the binder resin. When using as a result a wholly hydrophobic solvent, the neutralization reaction does not advance, and emulsion stabilization becomes harder to accomplish. The solvent therefore has some water solubility. Preferably, such an organic solvent can exhibit a compatibility of 5 to 100% towards water at 25° C. Specific examples of the organic solvent include, for instance, esters such as ethyl acetate and butyl acetate; glycols such as ethylene glycol, diethylene glycol, ethylene glycol monomethyl ether and diethylene glycol monomethyl ether; ketones such as acetone, methyl ethyl ketone (MEK) and methyl isobutyl ketone; and ethers such as tetrahydrofuran (THF). These organic solvents can be used alone or in combination. Preferably, the organic solvent has a boiling point of 50 to 100° C., more preferably of 60 to 90° C. A specific example thereof is methyl ethyl ketone (boiling point: 79.6° C. at normal pressure (1 atm)) or tetrahydrofuran (boiling point: 65° C. at normal pressure). The organic solvent is blended in a proportion of, for instance, 100 to 2,000 parts by weight, preferably 200 to 1,000 parts by weight relative to 100 parts by weight of binder resin.

In the preparation of the resin solution, a colorant dispersion is preferably prepared beforehand by micro-dispersing the colorant in a solvent. The method for dispersing the colorant may involve, for instance, mixing the colorant, a solvent and a dispersant, and pre-dispersing the mixture in a disper, a homogenizer or the like, followed by micro-dispersion in a bead mill, a high-pressure homogenizer or the like. In order to prevent colorant aggregation when preparing beforehand a colorant dispersion, the colorant dispersion is preferably diluted slowly first, and is then mixed with the resin and/or release agent to dissolve/disperse the foregoing during the preparation of the resin solution.

When using a dye or the like that dissolves in the solvent, the colorant need not particularly be dispersed. A dispersant for pigment dispersion is preferably used in order to micro-disperse the pigment. For instance, a surfactant or a high-molecular weight dispersant can be used as the dispersant. A binder resin may also function as a dispersant, and hence the binder resin may also be used as the dispersant.

(Preparation of a Base Microparticle Suspension: Step S20)

As illustrated in FIG. 1, an emulsion is prepared next by mixing and emulsifying the resin solution and the aqueous medium, after which the organic solvent component is removed by evaporation, thereby to prepare a suspension in which the base microparticles are dispersed in the aqueous medium.

The aqueous medium may be water, or a liquid mixture of water and an organic solvent compatible with water. Examples of the organic solvent include, for instance, an alcohol. Examples of additives that may be comprised in the aqueous medium include, for instance, surfactants, dispersants and the like. In the production method of the present invention, the aqueous medium is preferably prepared as an aqueous alkaline solution. Examples of the aqueous alkaline solution include an aqueous organic base solution prepared by dissolving a basic organic compound such as an amine in water, and an aqueous inorganic base solution prepared by dissolving an alkaline metal such as sodium hydroxide or potassium hydroxide in water. The aqueous inorganic base solution is prepared as an aqueous sodium hydroxide solution or aqueous potassium hydroxide solution of, for example, 0.1 to 5N (normal), preferably 0.2 to 2N (normal). If a wax poorly dissolvable in the resin solution is blended therein on account of water inclusion, then an aqueous organic base solution is preferably employed, in terms of preventing precipitation of the wax.

Emulsification can be carried out down to a much smaller toner particle size, of the order of 100 to 500 nm, due to the shearing imparted thereupon with a homogenizer or the like. Stabilizing the emulsion in this state and then removing the solvent allows to obtain a suspension having the base microparticles at the nm level dispersed therein. A dispersant is preferably used for emulsification. The dispersant, however, affects greatly the charge performance of the toner, and hence a dispersant capable of eliciting emulsion stabilization when added in as small an amount as possible may be selected.

In the production method of the present invention, emulsion stabilization is preferably accomplished without using the dispersant, but instead, a neutralizer (aqueous solution of an alkali such as sodium hydroxide) for neutralizing the acid groups (carboxyl groups and the like) in the binder resin is preferably used to impart hydrophilicity to the binder resin itself. A specific example of the neutralizer is sodium hydroxide. Emulsion stabilization is carried out by mixing the neutralizer with the aqueous medium or with the resin solution, or by adding the neutralizer after mixing the resin solution with the aqueous medium.

The solvent can be removed once the emulsion is stabilized. To remove the organic solvent from the emulsion, a conventionally known method such as air-blowing, heating, vacuum, or a combination thereof may be employed. For instance, the emulsion is heated in an inert gas atmosphere, from room temperature to 90° C., preferably from 65 to 80° C., until about 80 to 95 wt % of the initial amount of the organic solvent is removed. As a result, the organic solvent is removed from the aqueous medium, thereby to prepare a suspension (slurry) in which resin microparticles of the binder resin having the colorant and wax uniformly dispersed thereon is dispersed in an aqueous medium. For instance, the volume average particle size of the resin microparticles of the base microparticles ranges preferably from about 50 nm to about 500 nm.

The average particle size of the base microparticles can be determined by dynamic light scattering (laser Doppler), using a particle size analyzer Nanotrac™UPA150 (by Nikkiso Co. LTD.). The specific method used may be the method set forth in the examples.

Emulsification may be carried out by blending the resin solution into the aqueous medium or by blending the aqueous medium into the resin solution. A polyester resin is used in the present invention, and hence neutralization can be carried out by blending beforehand an alkaline aqueous solution and an amine-based solvent into a resin solution, and blending then water into the resin solution. Also, water may be blended into a resin solution neutralized beforehand.

(Production of Base Particles: Step S30)

In step S30, the base microparticles obtained in step S20 are aggregated to yield base particles. Firstly, the solids concentration in the suspension is adjusted by diluting the base microparticle suspension with water, as the case may require. In the suspension, any among an inorganic metal salt for emulsion aggregation (aggregating agent), an alkali (dispersion enhancer) and an ionic surfactant may be used. Examples of the aggregating agent include, for instance, inorganic metal salts such as calcium nitrate, and polymers of inorganic metal salts such as polyaluminum chloride. Examples of dispersion enhancers include, for instance, known dispersion enhancers such as sodium hydroxide. Examples of ionic surfactants include, for instance, sodium alkylbenzenesulfoante, polyoxyethylene alkylether ammonium (or sodium) sulfate, sodium alkylsulfosuccinate or the like. Examples of nonionic surfactants include, for instance, polyoxyalkylene decyl ether, polyoxyalkylene tridecyl ether, polyoxyethylene isodecyl ether, polyoxyethylene lauryl ether, polyoxyethylene styryl phenyl ether, polyoxyethylene polyoxypropylene glycol or the like.

During aggregation, an aqueous solution of the aggregating agent adjusted for instance to 0.01 to 1.0N (normal), preferably 0.05 to 0.5N (normal), is added, with stirring, at a ratio of for instance 0.1 to 10 parts by weight, preferably 0.5 to 5 parts by weight relative to 100 parts by weight of the suspension. The stirring method is not particularly limited. For instance, the suspension is dispersed in a high-speed dispersing apparatus such as a homogenizer, after which mixing proceeds using a stirrer equipped with stirring blades, to completely fluidize the suspension thereby. As the mixing blade there is used a well-known blade such as a flat turbine blade, a propeller blade or an anchor blade. Stirring may also be carried out using an ultrasonic disperser. The liquid temperature during stirring is, for instance, 10 to 50° C., preferably 20 to 30° C., and the stirring time is for instance 5 to 60 minutes, preferably 10 to 30 minutes. Thereafter, the suspension is preferably heated, to homogenize the aggregated state. Heating is carried out for instance up to a temperature at which particles do not fuse. In terms of preventing formation of coarse particles, heating is carried out preferably at a liquid temperature lower than the Tg of the base microparticles. For instance, the suspension is heated at a temperature of 35 to 60° C., more preferably temperature of about 40 to about 45° C.

Once the base microparticles have formed aggregates of desired size, an aggregation terminator is then added. The volume average particle size of the base particle ranges, e.g., from about 5 μm to about 20 μm. As the aggregation terminator an alkali aqueous solution or an ionic surfactant having an inverse polarity to that of the aggregating agent is used. For instance, an aqueous solution of sodium hydroxide is added as the aggregation terminator. The size of the base particles can be measured in accordance with the Coulter method using, for instance, a Coulter Multisizer II (by Beckman Coulter Inc.). The method set forth in the examples may be employed as the specific measurement method.

After addition of the aggregation terminator, the aggregate is fused by heating. That is, the suspension is heated, under continued stirring, at a temperature not lower than the glass transition temperature (Tg) of the resin. For instance, the suspension is heated at 55 to 100° C., preferably at 65 to 95° C. For instance, the suspension is heated up to a liquid temperature of 90° C. The aggregate undergoes shape changes when fusing, and hence heating and stirring are discontinued once the desired shape is achieved, followed by recovery of the suspension. In the present production method, it is preferable to continue the heating and stirring until a sphere-shape is obtained.

Examples of the aggregation terminator include alkaline metals such as sodium hydroxide and potassium hydroxide. An ionic surfactant may also be employed. When adding the aggregation terminator, an alkaline metal aqueous solution adjusted for instance to 0.01 to 5.0N (normal), preferably 0.1 to 2.0N (normal), is added at a ratio of for instance 0.5 to 20 parts by weight, preferably 1.0 to 10 parts by weight relative to 100 parts by weight of the suspension, while the suspension is continuously stirred.

(Carrying the Positively Charged Compound on the Surfaces of the Base Particles)

In this process, the positively charged compound is caused to be carried on the surfaces of the base particles. The base particle suspension obtained in step S30 after aggregation discontinuation is subjected to solid-liquid separation, as the case may require, and is re-suspended in an aqueous medium. The base particles and the positively charged compound are brought into sufficient contact with each other by supplying the positively charged compound to the base particle suspension. The positively charged compound is thereby carried on the surfaces of the base particles, on account of electrostatic effects, by bringing the positively charged compound into sufficient contact with the base particles in the base particle suspension. Causing the positively charged compound to be thus maintained on the surfaces of the base particles allows achieving a state in which negative charge control resin microparticles can readily adhere to the surfaces thereof. The base particles and the positively charged compound are preferably stirred over several minutes to several hours, depending for instance on the concentration of the base particles and of the positively charged compound. The positively charged compound need only be added in such a manner that it is soluble in the base particle suspension, and may be supplied in various forms, such as a powder, a liquid or a solution.

The positively charged compound can be arbitrarily selected from among known compounds and the specific compounds already explained. The amount of positively charged compound supplied to the base particles is preferably such that the number of positive charge sites of the positively charged compound relative to the weight of the base particles is not smaller than $6.60\times10^{-5}$ mol/g. A toner having a sufficiently high charge amount can be easily obtained when the amount of positively charged compound is not smaller than the above figure. Fogging and transfer residues are likelier to occur when the amount of positively charged compound is smaller than the above figure. More preferably, the number of positive charge sites of the positively charged compound, with respect to the weight of the base particles, is not smaller than $1.00\times10^{-4}$ mol/g.

After supplying the positively charged compound to the base particle suspension, the base particles carrying the positively charged compound are preferably subjected to solid-liquid separation. After the base particles and the positively charged compound are brought into contact, there may remain an excess of positively charged compound in the suspension. Depending on the amount of residue, the compound may obstruct the uniform fixing of the negative charge control resin microparticles. Therefore, the base particles carrying the positively charged compound are preferably separated by subjecting the suspension to the solid-liquid separation. The solid-liquid separation can be carried out by a known method such as filtering, centrifugation, decantation or the like. After the solid-liquid separation, the base particles may be re-suspended by washing with a suitable washing liquid such as water. Alternatively, the solid-liquid separation may be carried out while a washing liquid is being added.

After solid-liquid separation, the base particles carrying the positively charged compound are dispersed in a dispersion medium, such as water, to a predetermined solids fraction, to yield a base particle suspension that is used in the subsequent steps.

(Production of Toner Base Particles)

In this process, the toner base particles are produced by mixing the base particle suspension with the negative charge control resin microparticle suspension, to cause the negative charge control resin microparticles to be fixed to the surfaces of the base particles. The positively charged compound is added beforehand to the base particle suspension, and thus the negative charge control resin microparticles become fixed readily during the preparation of the toner base particles. The present toner base particle production process, therefore, allows negative charge control resin microparticles to be uniformly fixed to the surfaces of the base particles that have polyester resin as the main component, and allows fixing the negative charge control resin microparticles in the intended amount. The preparation of a negative charge control resin microparticle suspension used in the present process will be explained first, and the production of the toner base particles next.

(Preparation of a Negative Charge Control Resin Microparticle Suspension)

In the production method of the present teachings, a method for arranging the charge control resin microparticles on the surfaces of base particles is employed. Arranging the charge control resin microparticles on the surfaces of the base particles allows imparting charge characteristics effectively while using only a small amount of charge control agent. Also, carrying out adhesion/fixing to the base particle surfaces within a liquid is more suitable for homogeneous treatment than a dry method.

Firstly, the negative charge control resin is mixed with water and an organic solvent capable of dissolving or swelling the charge control resin, and the resulting mixture is emulsified in a high-speed stirrer such as a homogenizer. A suspension in which the charge control resin microparticles are dispersed in the aqueous medium can be obtained by removing the organic solvent component from the emulsion using a known method such as heating under reduced pressure. The size of the negative charge control resin microparticles can be controlled by adjusting the ratio between resin, solvent and water and by adjusting shear forces in the stirrer. The size of the negative charge control resin microparticles can also be controlled on the basis of, for instance, the molecular weight of the resin. The average particle size of the negative charge control resin microparticles can range, for instance, from 50 nm to 250 nm. The average particle size of the charge control resin microparticles can be determined by laser scattering using a Microtrac particle size analyzer Nanotrac™ NPA150 (UPA150, by Nikkiso Co. LTD.). The specific method used may be the method set forth in the examples.

The above-described method for producing a negative charge control resin microparticle suspension allows decreasing the amount of residual monomers in a negative charge control resin produced through solution polymerization. That is, the above-described method allows preparing a negative charge control resin microparticle suspension comprising virtually no monomer component, even in the case of a resin obtained through solution polymerization. Negative charge control resin microparticles can thus be obtained are suitable for the method for producing a negative charging toner of the present invention. Resins produced by emulsion polymerization or soap-free emulsion polymerization can also be used as the resin of the charge control resin microparticles.

(Mixing of the Base Particle Suspension and the Negative Charge Control Resin Microparticle Suspension)

Predetermined amounts of the base particle suspension and the negative charge control resin microparticle suspension are mixed together, and are stirred or the like in such a manner that the base particles and the charge control resin microparticles come into good contact with each other. Thereafter, the resulting mixture is heated under predetermined conditions, thereby to produce toner base particles upon which the negative charge control resin microparticles are fixed to the surfaces thereof. Preferably, the negative charge control resin microparticles are embedded to a certain extent into the toner surface. To that end, the charge control resin microparticles are preferably fixed at a liquid temperature around the Tg of the base particles. For instance, if the Tg of the base particles is 55° C., then the negative charge control resin microparticles are preferably mixed and then heated and stirred at a temperature of 55° C. for 15 to 60 minutes.

In the base particle production step as explained above, the toner base particles, comprising negative charge control resin microparticles on the surfaces of the base particles, are obtained in the form of a suspension comprising the particles.

(Washing)

In the washing operation, the toner base particles are recovered, for instance by filtering the obtained toner base particle suspension, and by washing. Washing can be suitably accomplished by, for instance, solid-liquid separation, washing and re-suspension.

By recovering, cooling, vacuum-filtering and drying the toner base particles obtained in accordance as above, toner base particles that carries negative charge control resin microparticles on the respective surfaces can thereby be obtained. In drying the toner base particles, it is preferable to dry until the water content of the toner base particle is lower than 1%. For example, the above toner base particle cake can be dried in a drier (with temperature 50° C.) for 24 hours or longer.

(Toner Production)

The toner base particles thus obtained as a result of the above operations are sufficiently charged themselves. However, it is preferable to cause an external additive to adhere to the surfaces of the toner base particles, with a view to enhancing fluidity and storage stability in the toner. Preferably in particular, an inorganic oxide hydrophobized using a silane coupling agent or the like is externally added. After addition of the external additive, the toner base particles may be sorted with a sieve or the like to yield the final toner.

The method for producing a negative charging toner of the present teachings, explained above, affords an excellent negative charging toner having fine surface charge state. Specifically, the teachings affords a uniform charge amount and a uniform charge distribution, in the toner itself as well as among the toner particles, which makes image defects such as fogging and transfer residues less likely to occur. At the same time, impurities such as surfactants are reduced in the toner. As a result, charge characteristics can therefore be preserved stably, and fine and clear images can be formed stably over long periods of time.

The negative charging toner obtainable in accordance with the method for producing a negative charging toner of the present teachings can be preferably used as a non-magnetic mono-component toner (i.e. single component developer), but can also be used as a two-component toner, for instance by being blended with a suitable carrier. As the carrier there can be used glass beads, steel shot or the like coated with a resin, in the case of cascade developing, or ferrite, iron dust or so-called binder-type carriers in the case of magnetic brush developing.

The negative charging toner obtainable in accordance with the method for producing a negative charging toner of the present teachings can be used as toner in electrophotographic and electrostatic-recording image forming apparatuses such as all manner of monochrome/color laser printers, fax machines, copiers and multifunction machines.

The present teachings will be explained in more detail next on the basis of specific examples. The teachings disclosed herein, however, are not limited to or by the examples below. In the examples, "parts" denote "parts by weight" and "%" denotes weight percent.

EXAMPLE 1

(Preparation of a Toner Resin Solution)

The starting materials below were mixed and heated at 45° C. to prepare a resin solution.

Polyester resin FC1565*1 17 parts by weight

Ester wax*2 1 part by weight

Nigrosine dye (charge control agent)*3 1 part by weight

Carbon black (colorant)*4 1 part by weight

Methyl ethyl ketone 80 parts by weight

*1 by Mitsubishi Rayon Co. LTD., Tg: 64° C.; Mn (number-average molecular weight): 5,000; Mw (weight-average molecular weight): 98,000; gel fraction (THF insoluble): 1.5 wt. %; acid value 6.1 mgKOH/g

*2 Unistar H476, by NOF Corporation

*3 Bontron No. 4, by Orient Chemical Industries, Ltd.

*4 Carbon black #260, by Mitsubishi Chemical Corporation

An aqueous medium was prepared by mixing 100 parts by weight of distilled water and 1 part by weight of a 1N aqueous solution of sodium hydroxide, followed by heating at 45° C.

Next, 100 parts by weight of the resin solution and 100 parts by weight of the aqueous medium were blended while keeping the temperature at 45° C., and were then stirred for 30 minutes at 16,000 rpm in a homogenizer DIAX900 (by Heidolph Japan Ltd.).

A 2 L separable flask was charged with 1,600 parts by weight of the obtained emulsion. The organic solvent was removed therefrom through heating and stirring at 70° C. for 150 minutes, while blowing nitrogen into the gas phase, to yield a suspension. The volume average size of the resin microparticles in the suspension was 256 nm. No precipitate was observed in the suspension. Thereafter, the suspension was diluted with distilled water to a suspension solids concentration of 10 wt %, to prepare 1600 parts of a suspension.

Next, 2.5 parts by weight of 0.2N aluminum chloride was added to 100 parts by weight of the suspension, with high-speed mixing for 10 minutes in a homogenizer. The suspension was heated then at a liquid temperature of 45° C. while being stirred at 300 rpm using six flat turbine blades. Stirring continued for 20 minutes. Thereafter, 2.5 parts by weight of a 0.2N aqueous solution of sodium hydroxide were added to the suspension, which was heated to a liquid temperature of 90° C., with continued stirring for about 5 hours until the toner base particles became spherical. The suspension was then cooled. After cooling, 2.5 parts by weight of a 1N aqueous solution of hydrochloric acid were added to 100 parts by weight of the suspension, followed by stirring for 1 hour to fluidize the suspension, after which the latter was filtered and re-suspended, to yield a base particle suspension.

(Preparation of a Negative Charge Control Resin Microparticle Suspension)

The starting materials below were mixed to prepare a resin solution.

Negative charge control resin FCA-1001NS*4 20 parts by weight

Methyl ethyl ketone 80 parts by weight

*4 by Fujikura Kasei Co. Ltd., Tg 59° C., Mw (weight-average molecular weight) 10,000, acid value 21.1 mg KOH/g Next, 100 parts by weight of the prepared resin solution were blended with 100 parts by weight of distilled water, and were then stirred for 20 minutes at 16000 rpm in a homogenizer DIAX900 (by Heidolph Japan Ltd.), to prepare an emulsion. A 2 L separable flask was charged with the obtained emulsion. The organic solvent was removed therefrom through heating and stirring at 60° C. for 90 minutes, while blowing nitrogen into the gas phase, to yield a negative charge control particle suspension. The negative charge control resin microparticles in the suspension had a volume average particle size of 70 nm.

(Production of Toners 1 to 9)

(Production of Toner Base Particles)

The positively charged compounds set forth in Table 1 were added to the above-described base particle suspension in the addition amounts given in Table 1, with stirring for 1 hour using a magnetic stirrer, followed by solid-liquid separation by vacuum filtering. The obtained solid component was dispersed in water to 10% solids. To this dispersion a negative charge control resin microparticle suspension so as to yield 3% of negative charge control resin microparticles relative to the base particles was added. Dispersion was carried out for 3 minutes under application of ultrasounds.

The resulting dispersion was poured, using a funnel, into a 2 L round-bottom separable flask immersed in a hot-water bath at 55° C., and was stirred for 30 minutes at 130 rpm with six flat stirring blades (diameter 75 mm, double blades). As a result, toner base particles in which negative charge control resin microparticles were fixed to the surfaces of the base particles were obtained.

The obtained toner base particles were transferred to a beaker, and were cooled, under stirring, to 30° C. or below in a vat with ice water. After cooling, the toner base particles were vacuum filtered, and the obtained particles were dried for two days at a temperature lower than the glass transition temperature, to yield dried toner base particles.

Further, 1.5 g of silica were externally added to 150 g of this toner base particles, over 5 minutes at 2500 rpm using a Mechanomill (by Okada Seiko Co. Ltd.), to yield a dry toner.

(PRODUCTION OF TONER 10) (COMPARATIVE EXAMPLE 1)

Toner 10 is a toner having base particles resulting from mixing a charge control resin with a polyester resin as the binder resin. Toner 10 was produced by modifying the production of the toners of the examples, as described below. Specifically, a resin solution was prepared in the same way as the resin solutions prepared above, but herein the negative charge control resin was added to 100% relative to the weight of base particles. A toner base particle dispersion was then obtained in the same way as above, by fusing the microparticles. The toner base particle dispersion was vacuum-filtered and the obtained particles were dried for two days at a temperature lower than the glass transition temperature, to yield toner base particles containing charge control resin microparticles. Then, 1.5 g of silica were externally added to 150 g of the obtained toner base particles, over 5 minutes at 2,500 rpm using a Mechanomill (by Okada Seiko Co. Ltd.), to yield a dry toner.

(PRODUCTION OF TONER 11) (COMPARATIVE EXAMPLE 2)

In toner 11, a dry toner was obtained in the same way as in toners 1 to 9, except that herein it was attempted of fix the negative charge control resin microparticles without causing a positively charged compound to be carry on the base particles.

TABLE 1

| Toner number | CCR mixing method | Positively charged compound and amount relative to base particle weight | Positive charge sites/ base particle weight mol/g | Adhesion homogeneity | Charge amount μC/g | Fogging | Transfer residue |
|---|---|---|---|---|---|---|---|
| 1 | Subsequent addition' | Polyallylamine 1.0% | $1.07 \times 10^{-4}$ | Homogeneous | −43.5 | ○ | ○ |
| 2 | Subsequent addition' | Polyallylamine 1.2% | $1.28 \times 10^{-4}$ | Homogeneous | −45.9 | ○ | ○ |
| 3 | Subsequent addition' | Polyethyleneamine 0.5% | $1.09 \times 10^{-4}$ | Homogeneous | −42.3 | ○ | ○ |
| 4 | Subsequent addition' | Polyethyleneamine 0.7% | $1.52 \times 10^{-4}$ | Homogeneous | −49.7 | ○ | ○ |
| 5 | Subsequent addition' | Benzethonium chloride 3.0% | $6.70 \times 10^{-5}$ | Homogeneous | −40.7 | ○ | ○ |
| 6 | Subsequent addition' | Benzethonium chloride 4.0% | $8.93 \times 10^{-5}$ | Homogeneous | −45.8 | ○ | ○ |
| 7 | Mixing from the start | None | Not detectable | Partially exposed | −28.2 | Δ | X |
| 8 | Subsequent addition | None | Not detectable | Not adhered | −5.1 | X | X |

The properties of the positively charged compound were as follows.

Polyallylamine: molecular weight about 60,000, about 640 positive charge sites per molecule Polyethyleneamine: molecular weight about 70,000, about 1520 positive charge sites per molecule Benzethonium chloride: molecular weight 448.08, 1 positive charge site per molecule (Evaluation)

Toners 1 to 8 were assessed for fogging and transfer residue. The evaluation methods were as set forth below. The results are summarized in Table 1.

Fogging and transfer residue in the obtained toners were evaluated using an HL-1850 (laser printer by Brother Kogyo K.K., developer TN-350, drum unit DR-350) modified for use with negative charge.

(Fogging Evaluation)

To evaluate fogging, a white solid pattern was printed, and the amount of charge on the developing roller was measured. The toner adhered to the surface of the photosensitive drum was transferred to an adhesive tape that was in turn affixed to Xerox 4200 paper. The difference in whiteness was then judged visually with reference to an adhesive tape to which no toner was transferred. In the above evaluation, total absence of fogging was denoted by double-circle (excellent), instances where presence of fogging could not be decided unless under intent gazing were denoted by circle (good), slight fogging in part of an A4 sheet was denoted by triangle (fair), and ostensible fogging was denoted by cross (poor).

(Transfer Residue Evaluation)

To evaluate transfer residue, a black solid pattern was printed, and the toner adhered to the surface of the photosensitive drum, after transfer, was transferred to an adhesive tape, which was in turn affixed to Xerox 4200 paper. The difference in whiteness was then judged visually with reference to an adhesive tape to which no toner was transferred. When no greater than 5, the whiteness difference was rated with marks of circle (good) while being marked cross (poor) when the whiteness difference was 5 or greater.

As Table 1 shows, negative charge control microparticles were adhered uniformly in toners 1 to 6. The charge amount increased also in accordance with the amount of positively charged compound used. No fogging or transfer residue was observed in toners 1, 2 and 3, 4, and toners 5 and 6. In toners 7 and 8, by contrast, adhesion (exposed state) of the negative charge control resin was poor or wholly unobservable. Toners 7 and 8 were deficient in terms of both fogging and transfer residue.

The above results indicate that a negative charging toner having a uniform surface charge state can be obtained by supplying and fixing negative charge control resin microparticles onto base particles carrying a positively charged compound, and indicate that a stable charge amount can be achieved by controlling the number of positive charge sites per base particle. The inventors succeeded in obtaining a negative charging toner having an increased/decreased amount of charge in accordance with an increase/reduction in the number of positive charge sites per base particle. The results in Table 1 show that a negative charging toner having improved charge amount and print characteristics can be easily obtained when the number of positive charge sites in the positively charged compound, relative to the weight of base particles, is not smaller than $6.60\times10^{-5}$ mol/g.

What is claimed is:

1. A method for producing a negative charging toner comprising a polyester resin as a main component, the method comprising the steps of:

preparing resin solution containing the polyester resin having carboxyl groups, a colorant and wax in organic solvent;

preparing base microparticle suspension by preparing emulsified liquid consisting of the resin solution and aqueous alkali solution and removing the organic solvent;

producing base particles by aggregating the base microparticles;

causing a positively charged compound to be carried on the surfaces of the base particles; and producing toner base particles by bringing the base particles carrying the positively charged compound into contact with negative charge control resin microparticles, such that the negative charge control resin microparticles are fixed to the surfaces of the base particles.

2. The method for producing a negative charging toner according to claim 1, wherein the step of causing the positively charged compound to be carried on the surfaces of the base particles comprises supplying the positively charged compound to a suspension of the base particles, and performing thereafter solid-liquid separation on the base particles carrying the positively charged compound.

3. The method for producing a negative charging toner according to claim 1 or 2, wherein in the step of causing the positively charged compound to be carried on the surfaces of the base particles, the number of positive charge sites of the positively charged compound with respect to the weight of the base particles is not smaller than $6.60\times10^{-5}$ mol/g.

4. The method for producing a negative charging toner according to claim 1, wherein the positively charged compound has a plurality of positive charge sites per molecule.

5. The method for producing a negative charging toner according to claim 1, wherein the positively charged compound has an amino group and/or a quaternary ammonium group as a positive charge site.

6. The method for producing a negative charging toner according to claim 1, wherein the positively charged compound is any one selected from the group consisting of polyallylamines, polyethyleneimines and benzethonium chloride.

* * * * *